United States Patent [19]

McComb

[11] 4,164,341

[45] Aug. 14, 1979

[54] SNOWMAN MOLD

[76] Inventor: Tiney M. McComb, Rte. #3, Box 43-A, Orient, Ohio 43146

[21] Appl. No.: 880,597

[22] Filed: Feb. 23, 1978

[51] Int. Cl.[2] ..... B28B 7/24

[52] U.S. Cl. ..... 249/126; 425/DIG. 57; 249/163

[58] Field of Search ..... 249/16, 48, 53, 126, 249/137, 166, 167, 192, 163, 55, 130, 132, 170, 171, 172; 425/DIG. 57

[56] References Cited

U.S. PATENT DOCUMENTS

| | | | |
|---|---|---|---|
| 1,170,049 | 2/1916 | Cunningham | 249/167 X |
| 2,352,083 | 6/1944 | Detjen | 249/55 X |
| 2,939,299 | 6/1960 | Sherbloom | 425/DIG. 57 |
| 3,059,279 | 10/1962 | Rossi | 249/126 X |
| 3,144,699 | 8/1964 | Williams | 249/48 |
| 3,788,590 | 1/1974 | Hasselbach | 425/DIG. 57 X |

*Primary Examiner*—Richard B. Lazarus
*Assistant Examiner*—John S. Brown
*Attorney, Agent, or Firm*—Robert E. Wagner; Gerald T. Shekleton

[57] ABSTRACT

An improved sectional mold for forming a large figure from snow, such as a snowman. Each section extends from the top of the mold assembly to its base and has flanges on the mold section periphery, each of which flanges is joined to the flange of an adjacent mold section by a U-shaped fastening clip. Large openings in one of the mold sections and at the top of the mold assembly admit snow for forming the desired figure.

5 Claims, 6 Drawing Figures

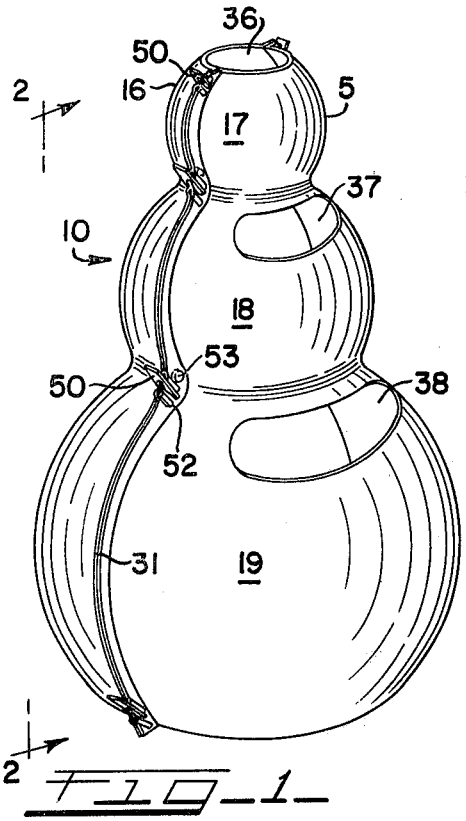
FIG. 1
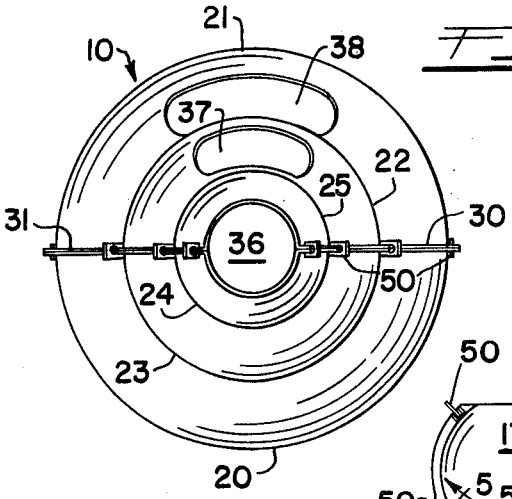
FIG. 4
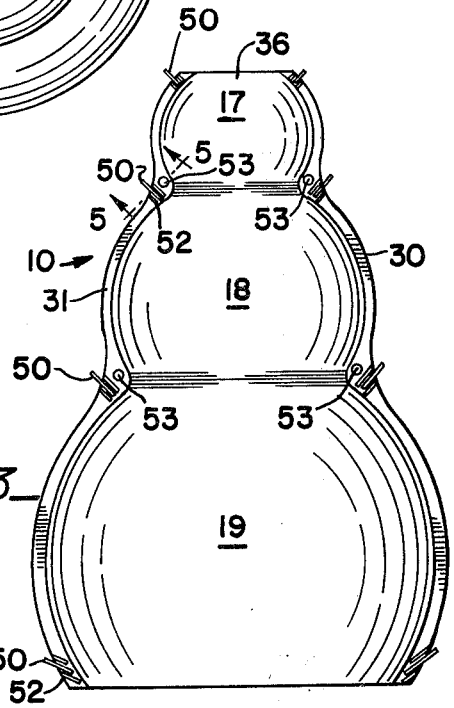
FIG. 3
FIG. 5
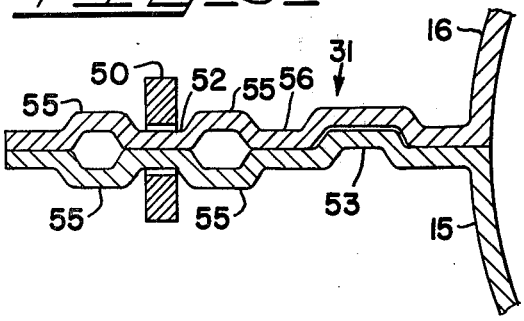
FIG. 6
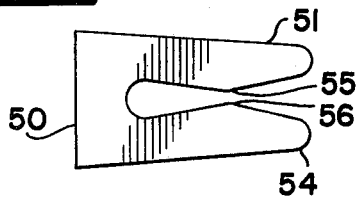
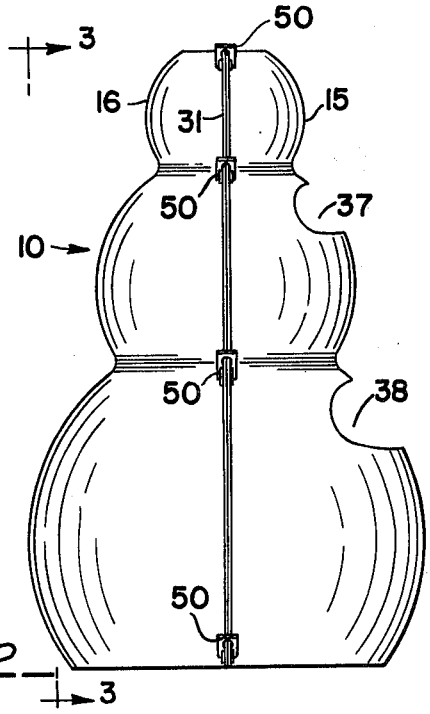
FIG. 2

SNOWMAN MOLD

BACKGROUND OF THE INVENTION

This invention relates to a snow mold, and more particularly to an improved sectional snow mold for forming large figures from snow.

In the traditional manner of forming snowmen or other figures of snow, large balls of packed snow are formed by rolling initially small snowballs in the snow until the desired size is reached. For small figures, no problem was generally presented in placing the finished packed balls of snow on top of each other to form the desired figure. However, in forming the larger figures, picking up the finished packed snowball for placement on the lower snowball, presented difficulty, if not hazards, especially for the very young and very old.

In an attempt to overcome these disadvantages and allow even a child to rapidly and easily make a large figure out of the packed snow, a snow mold as taught in U.S. Pat. No. 3,059,279 was developed in which the mold is formed in three sections each, each section being bipartite. The sectional mold was filled from an upper opening in each section; each individual section being mounted on top of the lower, larger section when that section was filled with snow.

SUMMARY OF THE INVENTION

The subject invention, in contrast to that taught by the prior art, is a bipartite mold which may be completely assembled prior to filling with snow. The mold sections extend longitudinally of the figure to be formed and have opposing peripheral flanges through which the mold sections are held together through fastening pins which allow the easy assembly and disassembly of the mold structure. On one mold section, large openings are formed in its midsection. In the formation of a snowman figure, these openings would appear on the upper third of the lower round section and on the upper third of the middle round section. These openings allow one to fill the assembled mold with snow, using the lower opening until the snow reaches the height of such opening and then using the middle section opening again until the height of the middle section opening is reached. A round opening is formed at the top or head of the assembled mold sections to allow the final filling of the mold with snow. When the mold is thus filled with snow, being packed correctly so as to substantially fill all of the mold, the fastening pins are withdrawn and the mold halves removed from the formed snow figure, which should then be free standing, and perfectly formed in the figure desired.

Therefore, an object of the subject invention is an improved snow mold for forming a desired figure of snow.

Another object of the subject invention is an improved snow mold which will allow the forming of a desired figure in snow without excessive lifting of large amounts of snow.

Still another object of the subject invention is an improved snow mold which allows the forming of snow figures regardless of the moisture content of the snow.

DESCRIPTION OF THE DRAWINGS

Further objects of the invention, together with additional features contributing and advantages accruing therefrom, will be apparent from the following description of one embodiment of the invention when read in conjunction with the accompanying drawings wherein:

FIG. 1 is a perspective view of one embodiment of the improved snow mold of the subject invention;

FIG. 2 is a side elevational view of the improved snow mold of FIG. 1;

FIG. 3 is a front elevational view of the improved snow mold of FIG. 1;

FIG. 4 is a top plan view of the improved snow mold of FIG. 1;

FIG. 5 is a cross sectional view taken along the line 5—5 of FIG. 3 showing the manner of attachment of the fastening pins; and, FIG. 6 is a side elevational view of the fastening pins of the subject invention.

Referring now to FIG. 1, there is shown one embodiment of the subject invention, an assembled snowman mold 10. The mold assembly 10 can be formed from two longitudinal hollowed-out halves 15 and 16 which, when placed together, form the outline of a traditional snowman shape, having three round hollow portions 17, 18 and 19 placed on top of each other in order of decreasing size. It should be recognized that other figures are envisioned, as within the scope of the subject invention for use with snow. In addition, more than two mold sections may be used if convenient in forming the desired figure, provided each mold section extends from the base of the figure to its uppermost section.

On the middle portion 18 and lower portion 19 are large openings 37 and 38 located on the upper third of each round portion providing easy access to the interior of the mold 10. Flanges 31 are formed on each mold section 15 and 16 in such a manner that when the mold sections 15 and 16 are joined to form the mold assembly 10, flanges 30 and 31 protrude from the round assembly 10 on opposing sides.

In one embodiment of the subject invention, the flanges extend only to the base of the mold sections, thereby leaving the base substantially flat. The substantial base surface area allowed by the size of the lower round mold portion 19 thus assures great stability of the mold assembly, both when empty, and when full of snow, even on slightly irregular or unlevel ground.

The upper rounded section 17 has a large opening 36 at the top and, with the other openings 37 and 38, provide for easy packing of the entire mold interior with snow as will be explained.

The flanges 30 and 31 provide channels or grooves 52 which accept anchoring pins or fasteners 50 which are in the nature of clothes pins and the like, having opposing arms 51 and 54 formed in a U-shape (FIG. 6). The arms 51 and 54 are flared at their outside end, reaching an intermediate point of close proximity at 55 and 56 respectively.

When inserted in grooves 52, the fasteners 50 retain the separate mold sections 15 and 16 together. These anchor channels 52 may be formed in the flanges 30 and 31 at the top and base of the mold assembly 10 and at convenient places in between, such as between the rounded sections of the mold assembly 10. As shown in FIG. 5, the flange is formed to provide channels 52 by upsetting pairs of sections 55 from the flanges 30 and 31. The opposing arms 51 and 54 of the anchor pin 50 are pressed over opposite sides of the channel 52 to bias the two flange portions of the mold sections 15 and 16 together (FIG. 5). Protrusions 53 on the flanges 30 and 31 are formed in identical locations in each mold half 15 and 16 to serve as alignment pegs, thereby insuring that the mold will be assembled in proper form. These protrusions may comprise an extended or upraised portion in mold section 15 which is matable into the depression formed by the upraised portion on mold section 16. There may be at least one alignment peg in each flange 30 and 31, and preferably two, to allow the molds to be easily mated and joined together with a minimum of problem. The alignment pegs are of a large size and preferably integrally formed into the flange so that it may not be broken off or otherwise deformed with the attendant loss of function.

The mold assembly may be stored when apart by nesting one mold half 15 inside the other mold half 16 to allow decreased storage space. When stored in such a manner, the alignment pegs 53 will form a channel at 56 in which the anchor pins 50 may be used to lock the mold into the storage position.

The use of the subject snowman mold assembly 10 allows for a simple nonlaborious manner of forming a snowman or other simple figure as desired. The mold halves 15 and 16 are joined together at the flanges and aligned through alignment pegs 53. The anchor pins 50 are forced into the channels 52. When each pin 50 is forced into each channel 52, i.e., at the top, middle, and base portion of the mold assembly 10, the mold will not be forced apart through the packing of snow into the interior of the mold assembly 10. After the mold assembly 10 is thus formed and locked together, snow is introduced into the interior of the mold assembly 10 through, first, opening 38 on the botton portion of the mold assembly 10 and then opening 37. Having filled the entire bottom portion through openings 37 and 38, the upper ball portion 17 is filled through top opening 36. After the snow is packed into the entire mold assembly in as complete and filling a manner as possible, the pins 50 are removed from the channels 52 and the mold halves 15 and 16 are removed from the completed snow figure. The figure thus formed is free standing and will now accept external decorations as desired.

In addition to the above-described uses as a snowman mold, it has been found that the mold assembly 10 can be used as an indoor or outdoor game which may be easily set up. In this game, bean bags may be tossed through the various openings 36, 37 and 38, awarding a higher number of points to the person throwing a bean bag in the higher openings, with opening 36 at the top of the snowman mold being awarded the greatest number of points on the tossing of the bean bag or other soft article through that opening. When used in such a manner, the game may be played indoors or outdoors as desired.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A hollow mold assembly for the forming of large figures from snow comprising at least two mold sections, each of said mold sections being substantially a mirror image of the other and extending in one piece from the top of the figure to be formed to the bottom, said mold sections being mateable to form a hollow figure, said figure being formed of successively smaller substantially spherical portions, including a base portion, a body portion and a head portion, and at least three large openings formed in said mold sections for the admission and packing of snow to the entire interior of said mold, each of said openings being associated with one of said spherical portions for the easy admission of snow to each respective spherical portion.

2. The hollow mold assembly of claim 1 wherein a locking means is positionable in a channel formed in said flange for biasing said first and second mold sections together.

3. The hollow mold assembly of claim 1 wherein said mold sections have peripheral flanges, said flanges having an alignment means for assuring the aligned joinder of said mold sections.

4. The hollow mold assembly of claim 3 wherein said mold sections have an alignment means comprising an upraised portion of one mold section and a depressed portion of an adjacent mold section, said upraised portion and said depressed portion mating to assure the correct placement of each of said mold sections.

5. The hollow mold assembly of claim 3 wherein said flanges are formed on a middle portion only on each of said mold sections, thereby leaving the base of each of said mold sections substantially flat to allow said assembly to be free standing when assembled.

* * * * *